US005252796A

United States Patent [19]

Hedger

[11] Patent Number: 5,252,796

[45] Date of Patent: Oct. 12, 1993

[54] SIGNAL TUBE OPERATED SWITCHES

[76] Inventor: John T. Hedger, Lot 15, Symington Road, Melton, Australia, 3337

[21] Appl. No.: 840,562

[22] Filed: Feb. 24, 1992

Related U.S. Application Data

[63] Continuation of Ser. No. 620,201, Nov. 30, 1990, abandoned.

[30] Foreign Application Priority Data

Dec. 1, 1989 [AU] Australia ..... PJ7653

[51] Int. Cl.[5] ..... H01H 35/24

[52] U.S. Cl. ..... 200/82 R; 200/83 R

[58] Field of Search ..... 200/61.08, 61.52, 61.53, 200/81 H, 81.4, 82 R, 83 R, 83 B, 83 J, 83 V, 83 N, 60

[56] References Cited

U.S. PATENT DOCUMENTS

| | | | |
|---|---|---|---|
| 1,458,925 | 6/1923 | Barab | 102/206 |
| 2,763,773 | 9/1956 | Morente | 200/61.52 X |
| 3,603,983 | 9/1971 | Mitchell | 200/81.4 X |
| 3,715,985 | 2/1973 | Fugelso | 200/61.53 X |
| 3,911,393 | 10/1975 | Biggs | 200/83 N |
| 3,932,717 | 1/1976 | Dike et al. | 200/61.08 |
| 4,043,076 | 8/1977 | Potrzuski et al. | 200/61.52 X |
| 4,124,841 | 11/1978 | Kettunen | 200/61.52 X |
| 4,150,266 | 4/1979 | Patrichi | 200/61.08 |
| 4,183,005 | 1/1980 | Meister et al. | 200/61.08 X |
| 4,339,638 | 7/1982 | Lascelles et al. | 200/61.08 X |
| 4,890,090 | 12/1989 | Ballyns | 340/442 |
| 4,911,076 | 3/1990 | Rowe | 102/275.3 |
| 5,028,749 | 7/1991 | Hodate | 200/61.25 |
| 5,070,787 | 12/1991 | Weldon et al. | 200/82 R X |

*Primary Examiner*—J. R. Scott

*Attorney, Agent, or Firm*—James Creighton Wray

[57] ABSTRACT

A signal tube operated switch includes a contact arrangement which is moved from a first, open circuit position to a second, closed circuit position by a shock wave or pressure pulse initiated by a detonator. The switch is preferably an electric switch and in at least one embodiment includes a movable conductive piston consisting of at least one portion in continuous conductive engagement with the conductive signal tube. The other portion of the contact arrangement causes a change in the circuit after the contact arrangement is relocated to the second circuit closing position. Accordingly, the overall working efficiency of delay detonators is improved.

15 Claims, 3 Drawing Sheets

SIGNAL TUBE OPERATED SWITCHES

RELATED APPLICATIONS

This application is a continuation of U.S. application Ser. No. 07/620,201, filed Nov. 30, 1990, now abandoned.

BACKGROUND OF THE INVENTION

This invention relates to improvements in signal tube operated switches and particularly those switches for operation of an external circuit. One particular application is in the operation of delay detonators.

A relatively recent development in the explosives industry has been the use of signal tubes or shock tubes which are sold, for example, under the trade names Primadet, Nonel, hereinafter called signal tubes, for the initiation of detonators. Until the present time signal tubes have been used solely to provide a means of transmitting an initiating pulse from one detonator to another. Signal tube is ideally suited to this application because it is very resistant to accidental initiation, can propagate over an indefinite length and the detonation wave is fully contained within the tube.

Delay detonators are used extensively in the mining industry to initiate explosive charges in a predetermined sequence. There are two conventional types, electric and non-electric both of which consist of a metal (usually aluminium) tube (detonator tube) into which charges of a primary explosive (usually Lead Azide) and a secondary explosive (usually PETN) have been pressed. A length of pyrotechnic substance is then forced into the detonator tube on top of the explosive charge.

In an electric delay detonator the pyrotechnic substance is ignited by a small charge of pyrotechnic material located around some form of resistive wire or junction (usually referred to as a fusehead or ignition charge). Wires are attached to the terminals of this resistive wire or junction and are then connected to an electrical power supply usually referred to as a shot exploder.

The other is a signal tube detonator. In a non-electronic detonator the pyrotechnic substance is ignited by a signal tube which is typically of 3 mm outside diameter and 1 mm inside diameter; the inside of the tube is covered with a thin layer of explosive or reactive material and is attached to the detonator tube directed towards the pyrotechnic substance. Once initiated a shock wave will propagate through the tube and has sufficient energy to ignite the pyrotechnic substance.

There are a number of applications where one or other of the electric or non-electric delay detonator can only be used, for example, the signal tube type non-electric detonator cannot be used in gassy coal mines due to the danger of igniting the atmosphere. However, non-electric systems possess certain advantages including their ease of connecting up, very good tolerance to static electricity discharges and the ability to initiate a substantial number of subsequent charges in the blast once initiated by a single detonator or suitable initiator.

By comparison, the electric system is limited by two further factors; first, the number of initiating sequences is limited to the number of specific delay times that the manufacturer produces and, second, the shot exploder is only able to fire a given limited number of detonators. Both conventional types of detonator however, poses the disadvantage in that they have a limit of accuracy and precision of 1-2% which is viewed as less than desirable in most industries particularly the mining industry where greater control of rock fragmentation, ground vibration and improvement of overall efficiency is required. This is due to the inaccuracies inherent in the use of pyrotechnics as delay devices.

While there has been some development in the use of electronic delay devices and systems which would provide a limit of accuracy and precision of the order of 0.01-0.1%, there has been no device produced which combines or embodies the electronic delay timing system with the non-electric delay detonator system to maximise the overall efficiency of delay detonators.

SUMMARY OF THE INVENTION

The principal object of the invention is to provide a signal tube operated switch which would have application in such an area, as well as in other applications.

In its broadest sense the invention includes a switch operable by a signal tube, the switch having an external circuit associated therewith, the switch including means actuated by the output of the signal tube to be moved directly or indirectly to effect a change in the status of the circuit.

The initiation is preferably by a shock wave or pressure pulse.

The means actuated by the output of the signal tube may be a piston which is caused to move by the pulse to operate the switch. The switch is preferably an electric switch and the piston is adapted to open or close the circuit but the switch could be an hydraulic or pneumatic valve, or it could be a fibre optics switch.

BRIEF DESCRIPTION OF THE DRAWINGS

In order that the invention may be more readily understood we shall describe several embodiments of the invention in association with the accompanying drawings in which.

DETAILED DESCRIPTION OF THE DRAWINGS

The description will be in relation to an electric switch adapted to initiate an electronic delay detonator and for this application the switch of the invention is located in a standard detonator shell 10 but it will be appreciated that there may be other applications where it could be located in different types of containers.

Figure 1:
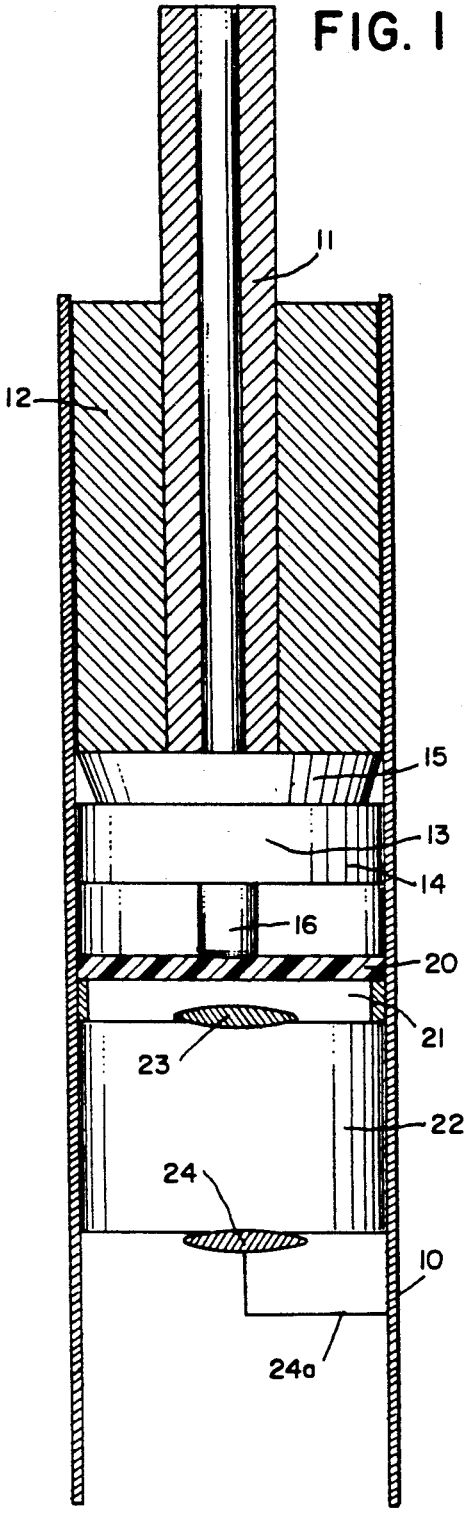
FIG. 1 is a first embodiment largely in section.

As illustrated in FIG. 1 the signal tube 11 passes into the end of the detonator shell 10 and is enclosed by a closure plug 12.

This plug may be formed in situ, by incorporating a sealant material about the signal tube, or could be located over the signal tube before location.

Normally the detonator shell would then be crimped around the closure plug adjacent the outer end thereof.

It will be appreciated from the subsequent description that the signal tube should be in a sealed relationship with the plug 12 and the plug with the shell 10.

Located in the detonator shell 10 below the plug there is a piston 13 which has a body 14 which is a relatively close fit within the shell and may be provided with a seal 15 the outer edge of which makes wiping contact with the detonator shell.

The piston 13 has a body portion 14 which is a relatively close fit within the shell and is provided with a sealing skirt 15 extending upwardly therefrom and which makes a wiping contact with the shell.

Extending from the lower end of the piston there is a pin 16 which is preferably formed integrally with the piston.

Located in the shell 10 and beneath the piston 13 there is a diaphragm 20 which is made of an insulating material and this may be associated with an annular spacer 21 which is in contact with the upper surface of a battery 22.

One of the battery contacts 23 is shown as being on the top of the battery and the second contact 24 on the bottom of the battery.

The contact 23 is located directly beneath the pin 16 and it will be appreciated that if some different form of battery was to be used then the pin 16 may need to be incorporated in a different place so as to be in alignment with the equivalent terminal.

The terminal 24 may be in direct contact with the external circuit which may also be in contact with the detonator shell 10. Conductor **24*a* illustrates such an arrangement in FIGS. 1–5**.

In operation of the switch of this embodiment the signal tube is operated to provide a shock pulse at its free end and this is achieved in the conventional way.

When the pulse is received there is a pressure build-up on the piston head and the piston is caused to move downwardly towards the battery and the pin pierces the insulating diaphragm and comes into contact with the battery terminal 23.

In experiments, using commercially available signal tubes, I found that the piston could move up to approximately 20 mm and operate effectively and, this effective operation could be over a greater distance. Of course the distance which the piston can be caused to move and still effectively perforate the diaphragm will depend upon the actual signal tube and the pulse received on the piston head.

When the pin 16 passes through the insulating diaphragm and contacts the battery terminal 23 the circuit is made as the battery is connected to the detonator shell through the piston.

I have found experimentally that the pin 16 of the piston moves positively into contact with the battery terminal 23 and even physical movement has not varied this.

Also, experimentally, I have shown that over a number of shots the switching time was between 200 and 500 micro seconds.

This does enable a good control over the total time of the operation of the signal tube and an electronic delay circuit.

Practically I see certain difficulties in the arrangement of FIG. 1 in that when the closure plug 12 is being crimped onto the signal tube 11 by deformation of the detonator shell 10 there can be some deformation in the shell which may prevent the piston 13 from moving truly.

Figure 2:
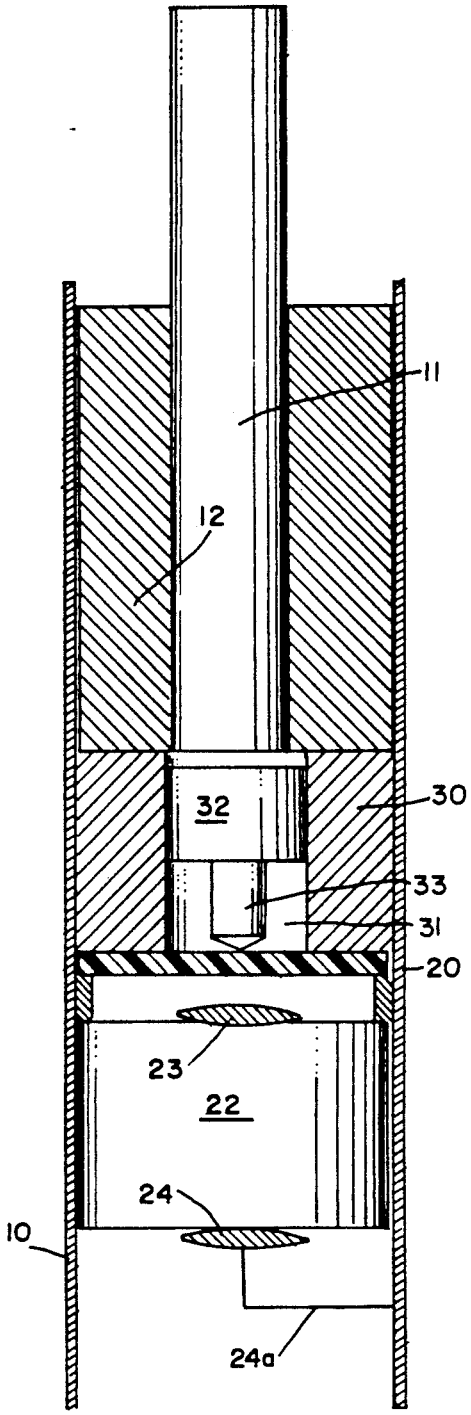
FIG. 2 is a modification of the embodiment of FIG. 1.

In the embodiment of FIG. 2 this has been overcome.

In this case I incorporate a piston barrel 30 between the closure plug 12 and the insulating diaphragm 20 which barrel has a bore 31 which is substantially less than the total bore of the detonator shell and which has a piston 32 located therein the piston having a pin 33 extending downwardly therefrom.

In this embodiment as the bore 31 and the diameter of the piston 32 are well able to be controlled I found that over a number of trial shots the assembly switched consistently within 200 micro seconds.

The arrangement of the battery 22 and the diaphragm 20 in this embodiment can be considered to be identical to that of the embodiment of FIG. 1.

Figure 3:
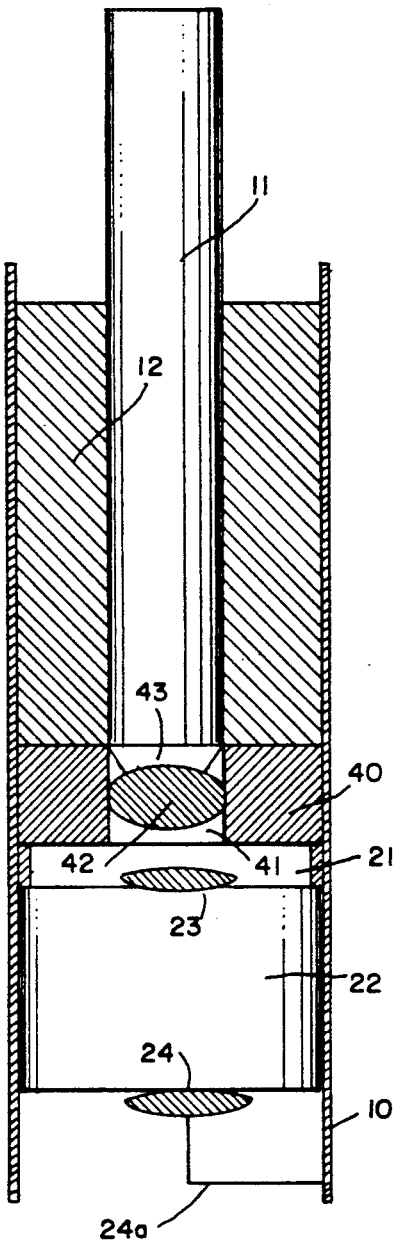
FIG. 3 is a third embodiment which is generally similar in operation to those of FIGS. 1 and 2.

The embodiment of FIG. 3 can be considered very similar to that of FIG. 2 except the barrel 40 has a bore 41 which is of a diameter to receive a standard lead pellet 42 and the pellet is used as the piston having a piston head 43.

I found that this embodiment switched within 500 micro seconds.

It will be seen from the description of the previous embodiment that the arrangement used as the piston can vary widely.

Whilst it may normally be desirable to have a surface area on the piston head which is greater than the diameter of the pin which passes through the diaphragm there may be applications where this could be, say, a needle which is a close fit in the signal tube and which acts as a piston as well as the pin which passes through the diaphragm.

All such arrangments are within the scope of the present invention.

Figure 4A:
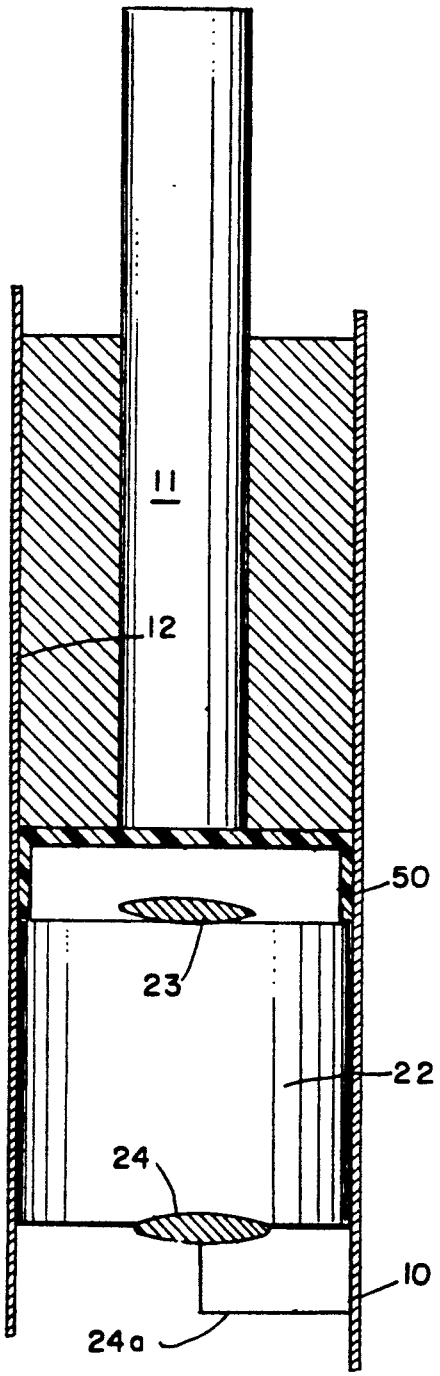
FIG. 4A shows a further embodiment in its unswitched condition.
Figure 4B:
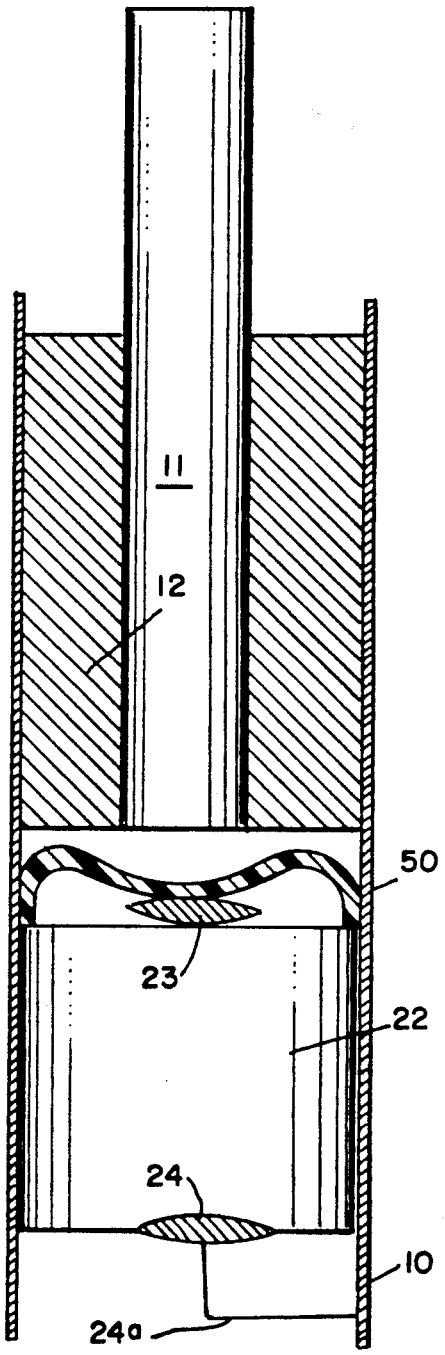
FIG. 4B shows the embodiment of FIG. 4A switched.

In the embodiment of FIGS. 4A and 4B, instead of using a piston and diaphragm arrangement I provided a metal diaphragm 50 in the detonator shell 11 and spaced from the diaphragm in the direction away from the signal tube can be located a terminal of a battery 22 or some conductor associated therewith.

In this embodiment the pressure from the signal tube causes a deformation of the diaphragm as shown in FIG. 4B so that it moves towards and in contact with the battery terminal or conductor.

Whilst a flat diaphragm is illustrated, it may be possible to use a shaped diaphragm which is directed upwardly but which, after the pressure shock is deformed, to be directed downwardly into positive contact with the battery terminal or conductor.

Figure 5:
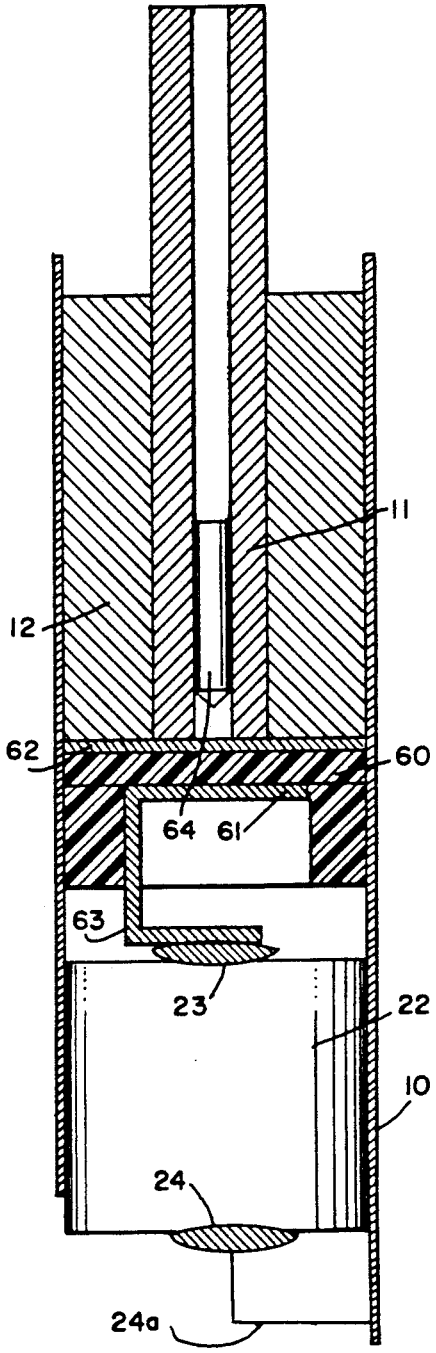
FIG. 5 shows a still further embodiment.

In the embodiment of FIG. 5, I provided a diaphragm 60 which is of insulating material and which had conducting material 61 and 62 on the opposite sides thereof.

The conducting material 62 is in connection with the detonator shell and material 61 is connected by link 63 to the battery terminal. In this case I use a projectile, in the form of a needle 64 which is caused to pass through the diaphragm 60 and which makes contact between the two conducting layers 61 and 62 thus closing the switch.

This arrangement may use a needle or a pin or the like attached to a piston as described in earlier embodiments.

I have indicated that one preferred external circuit could be an electronic delay timing circuit of the type known in the explosives art.

These circuits can provide a delay time of between 10 and 10,000 milliseconds between the application of current to the circuit and the initiation of the circuit explosive charge. The times of the delay circuit can of course be varied but the switch of the invention could be most useful for initiating operation of such circuits.

The form of battery used is not in itself important to the invention but it will be understood that it must be a battery which can maintain its charge for a relatively long shelf life and which, when switched into the circuit, can provide the required current.

I prefer to use lithium based batteries but these are not critical.

The battery must be able to provide sufficient current to provide the external circuit for the duration of the period which this is needed and where this is a delay circuit to then provide sufficient current to initiate operation of the chosen fuse head or initiating device.

Typically this will be 1 to 2 amps for 1 to 2 milliseconds.

In each of the embodiments, the switch closes a circuit. It could in some application operate to open the circuit.

Although not illustrated, the switch could be a pneumatic or hydraulic valve or could interrupt or permit the transmission of light.

I claim:

1. A switch having a body, an explosive signal tube in connection therewith, at least one contact arrangement for contacting a power source placed within the body, the contact arrangement including a first conductive movable contact means being in conductive contact with the body and further having a second conductive movable integrally formed contact means for effecting an electrical connection with the power source, the contact arrangement being movable when a pressure pulse is received from the signal tube thereby making the electrical connection between the contact arrangement and the power source.

2. A switch as claimed in claim 1 wherein the contact arrangement comprises a piston being the first contact means which is in contact with an end of the signal tube and moveable on an output from the signal tube to effect a change in status of an external circuit formed by the body, the first and second contact means and the power source.

3. A switch as claimed in claim 2, wherein the body of the switch is a detonator shell and the external circuit forms an electronic delay detonator.

4. A switch as claimed in claim 2 wherein there is a member between the piston and the power source which normally acts as a barrier, at least part of the piston being adapted to form the second contact means, the second contact means being movable to pass through the member to effect the change in status of the electrical circuit.

5. A switch as claimed in claim 4 wherein the member between the signal tube and the power source is deformable on receiving the pulse from the signal tube to effect the change in status of the circuit.

6. An electric switch operable by a signal tube, the switch comprising a body, a source of electric power within the body, and a contact means connected thereto through the switch, such that when the contact means is actuated by a pressure output received from the signal tube to be moved into or out of contact with the power source, the contact means effects a change in status of an external circuit formed by the body, the contact means and the source of power.

7. A switch as claimed in claim 6 wherein the body is a detonator shell and the external circuit forms an electronic delay detonator.

8. A switch as claimed in claim 6 wherein the contact means are movable into contact with the source of power to complete the circuit.

9. A switch as claimed in claim 8 wherein the contact means comprises a piston being in contact with an end of the signal tube and moveable on receiving the pressure output from the signal tube for moving towards the source of power associated therewith to effect a completion of the circuit.

10. A switch as claimed in claim 9 wherein the source of power is a battery and wherein the piston is moved into contact with the battery.

11. A switch as claimed in claim 9 wherein there is a member between the signal tube and the source of power which is deformable on receiving the pressure output from the signal tube to come into contact with the source of power associated therewith.

12. A switch as claimed in claim 9 wherein there is a member between the piston and the source of power associated therewith which normally acts as a barrier between the piston and the source of the power.

13. A switch as claimed in claim 12 wherein the member is an insulator and is pierced by the piston when the piston is moved towards the source of power.

14. A switch as claimed in claim 12 wherein the member is a conductor and is moved into contact with the source of power by the piston.

15. A switch as claimed in claim 8 wherein the member is an insulator and has a conductor on each side thereof, and wherein the piston is a conductor, the circuit being completed by the piston passing through the member and contacting the conductors associated with the member.

* * * * *